US007918536B2

(12) United States Patent
Ono

(10) Patent No.: US 7,918,536 B2
(45) Date of Patent: Apr. 5, 2011

(54) INK JET RECORDING APPARATUS WITH ADHESIVELY BONDED INK JET HEAD CHIP

(75) Inventor: Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 612 days.

(21) Appl. No.: 11/957,067

(22) Filed: Dec. 14, 2007

(65) Prior Publication Data

US 2008/0143784 A1 Jun. 19, 2008

(30) Foreign Application Priority Data

Dec. 18, 2006 (JP) ..... 2006-339975
Nov. 16, 2007 (JP) ..... 2007-297957

(51) Int. Cl.
*B41J 2/14* (2006.01)
*B41J 2/16* (2006.01)

(52) U.S. Cl. ..... 347/50; 347/65; 347/63

(58) Field of Classification Search ..... 347/20, 347/44, 47, 49–50, 56–59, 61–65, 67
See application file for complete search history.

(56) References Cited

U.S. PATENT DOCUMENTS 6,334,674 B1 1/2002 Ono et al. ..... 347/86
6,609,782 B2 * 8/2003 Mori ..... 347/50
6,896,359 B1 * 5/2005 Miyazaki et al. ..... 347/58

FOREIGN PATENT DOCUMENTS

JP 2000-218803 8/2000
JP 2001-150680 6/2001

* cited by examiner

*Primary Examiner* — Juanita D Stephens
(74) *Attorney, Agent, or Firm* — Fitzpatrick, Cella, Harper & Scinto

(57) ABSTRACT

An ink jet head includes a recording element substrate includes a plurality of ink supply ports and a supply port partition between adjacent ink supply ports; a substrate supporting portion supporting the recording element substrate at a back side thereof, the substrate supporting portion including ink supply passages corresponding to the ink supply ports and a supply passage partition corresponding to the supply port partition; a sealing material contacted to a side surface of the recording element substrate and to the substrate supporting portion; adhesive material fixing the opening partition and the supply passage partition to each other, wherein back sides of opposite ends of the recording element substrate with respect to an arranging direction of the ink supply ports are unfixed by the adhesive material to the substrate supporting portion.

4 Claims, 7 Drawing Sheets

INK JET RECORDING APPARATUS WITH ADHESIVELY BONDED INK JET HEAD CHIP

FIELD OF THE INVENTION AND RELATED ART

The present invention relates to an ink jet recording cartridge (ink jet print cartridge) which jets liquid, such as ink, from its liquid jetting openings.

In the case of an ink jet recording apparatus cartridge in accordance with the prior art, the ink jet head chip is solidly bonded to the ink jet head chip supporting portion of the housing (outer shell) of the cartridge, only by the back surface of the substrate of the ink jet head chip on which a structural member having ink jetting holes (openings) has been formed (Japanese Laid-open Patent Applications 2000-218803 and 2001-150680). FIG. 9 is a schematic sectional view of an ink jet head in accordance with the prior art. In the case of the ink jet head shown in FIG. 9, the ink jet head is attached to the ink jet head supporting portion 2 (which hereafter will be referred to as head supporting portion 2), by the back surface of the substrate 1 of the ink jet head, with the use of a dab of adhesive 3. In other words, the adhesive 3 is applied only to the back surface of the head substrate 1, and then, the ink jet head is joined with the head supporting portion 2.

FIG. 10 is a schematic sectional view of another ink jet head in accordance with the prior art. In the case of the ink jet head shown in FIG. 10, each of the portions 4 of the head substrate, which separates adjacent two common ink channels 7 of the ink jet head, is bonded to the corresponding ink delivery passage separating portion 5 of the head supporting portion 2, with the use of the adhesive 3, and also, the back surface of each of the end portions of the head substrate 1 is bonded to the head supporting portion 2. Further, the adhesive 3 is applied so that it covers even the surface of each of the common ink channels 7, which is next to the surface of the common ink channel separating portion 4, which faces the ink delivery passage separating portion 5.

As described above, in the case of the method, in accordance with the prior art, for manufacturing an ink jet head, when an ink jet head is attached (bonded) to the head supporting portion 2, the adhesive 3 is applied across the entirety of the areas of the head substrate 1, by which the ink jet head is bonded to the head supporting portion 2.

The prior art described above with reference to FIGS. 9 and 10, however, suffers from the following problems:

(1) The ink jet head substrate 1 is ordinarily formed of silicon. Therefore, the head substrate 1 is generally smaller in coefficient of linear expansion than a member which supports the ink jet head (by head substrate 1).

Therefore, in a case where the head substrate 1 formed of silicon is supported by the head supporting portion 2, if the adhesive 3, which is to be thermally cured, is applied so that it will be present across the entirety of the contact area between the head substrate 1 and head supporting portion 2, the head substrate 1 is subjected to tensional force, the strength of which corresponds to the amount of difference in coefficient of thermal expansion between the head substrate 1 and head supporting portion 2, by the heat applied to cure the adhesive 3. On the other hand, the head substrate 1 is subjected to compressive force while the thermally cured (hardened) adhesive 3 cools down. Therefore, the head substrate 1 is sometimes deformed by these forces.

FIGS. 11A and 11B are schematic sectional views of the head substrate 1 and head supporting portion 2, which is being deformed by the above described forces. FIG. 11A shows the head substrate 1 and head supporting portion 2, which are expanding due to the presence of the heat for hardening the adhesive 3.

When the head substrate 1 and head supporting portion 2 are in the state shown in FIG. 11A, the head substrate 1 hardly expands in the direction indicated by an arrow mark D1, that is, the direction of the tensional force to which the head substrate 1 is subjected, because the head substrate 1 is very small in coefficient of thermal expansion. On the other hand, the head supporting portion 2, which is formed of resin, is greater in the amount of expansion in the direction indicated by an arrow mark D2, that is, the direction in which the head supporting portion 2 expands due to the present of the head applied to harden the adhesive 3, than the head substrate 1. The adhesive 3 hardens while the head substrate 1 and head supporting portion 2 are in the above described state shown in FIG. 11A. Therefore, the head substrate 1 and head supporting portion 2 are solidly attached to each other while remaining in the state shown in FIG. 11A.

FIG. 11B shows the head substrate 1 and head supporting portion 2, which have cooled down to the room temperature after the hardening of the adhesive 3 while they remained in the state shown in FIG. 11A. The head substrate 1 hardly expanded in the direction D1 in FIG. 11A during the heating of the adhesive 3, and therefore, it is smaller in the amount of contraction in the direction indicated by an arrow mark D3, which occurs while the head substrate 1, head supporting portion 2, and adhesive 3 are cooled to the room temperature. On the other hand, the head supporting portion 2 is greater in the amount of thermal expansion, as shown in FIG. 11A, which occurs while heat is applied, than the head substrate 1. Therefore, the amount by which it contracts in the direction indicated by an arrow mark D4 while it cools down to the room temperature, is greater than the amount by which the head substrate 1 contracts in the direction indicated by an arrow mark D3 during the cooling it is greater in the amount of contraction which occurs while it cools down to the room temperature. Therefore, the head substrate 1 is subjected to such a force that acts in the direction to compress it inward (direction indicated by white arrow mark D3 in drawing) from both ends in terms of the direction perpendicular to the lengthwise direction of the common ink channel 7. Therefore, the head substrate 1 sometimes deforms at both ends, in terms of the abovementioned direction, as shown in FIG. 11B, which in turns causes the entirety of the head substrate 1 to bow in a manner to displace its center portion away from the head supporting portion 2.

(2) Ordinarily, the backside of the head substrate 1 is covered with a thin layer of oxide resulting from the thermal or natural oxidization. These films of oxide are in less adherent to the adhesive 3 than the plain silicon. Therefore, an ink jet head bonding method, such as the above described ink jet bonding method in accordance with the prior art, which bonds an ink jet head to the head supporting portion 2 by applying the adhesive 3 so that the adhesive 3 will be only between the back surface of the head substrate 1 and the corresponding portions of the head supporting portion 2 sometimes allowed the head substrate 1 to separate from the head supporting portion 2 after the hardening of the adhesive 3.

(3) The separation of one or more of the portions 4, each of which separates the adjacent two common ink channels 7, from the corresponding ink delivery passage separating portion 5 of the head supporting portion 2 after the hardening of the adhesive 3 caused the following problems:

In the case of an ink jet head which jets multiple inks different in color, that is, an ink jet head, the common ink channels 7 of which are different in the color of the inks they channel, it occurred sometimes that the inks in the adjacent two common ink channels 7 mix with each other, making it therefore difficult to keep an ink jet head at a preset level in terms image quality.

Further, also in the case of an ink jet head made up of a single substrate 1, and a structural component bonded to the substrate 1 and having multiple rows of ink jetting holes (openings), which are the same in the color of the inks they jet, the ink jetting holes (openings) sometimes became nonuniform in the amount by which ink is jetted therefrom, causing the ink jet head to yield an image of low quality.

SUMMARY OF THE INVENTION

The primary object of the present invention is to provide an ink jet recording cartridge, the substrate of the ink jet head chip of which does not deform or separate from the ink jet head supporting portion of the housing (outer shell) of the ink jet recording cartridge, by provide an innovative method for attaching (bonding) an ink jet head chip to an ink jet head supporting portion, which is characterized in that the method for bonding certain areas of the ink jet head substrate to the ink jet head supporting portion is made different from the method for bonding the other areas of the ink jet recording head substrate to the ink jet head supporting portion, in order to prevent the ink jet head chip substrate from deforming or separating from the ink jet head chip supporting portion, by virtually eliminating (or minimizing) the amount of the stress which occurs to the ink jet head chip substrate because of the difference in coefficient of linear expansion between the ink jet head chip substrate and ink jet head supporting portion.

According to an aspect of the present invention, there is provided an ink jet head comprising a recording element substrate including a plurality of ink supply ports and a supply port partition between adjacent ink supply ports; a substrate supporting portion supporting said recording element substrate at a back side thereof, said substrate supporting portion including ink supply passages corresponding to said ink supply ports and a supply passage partition corresponding to said supply port partition; a sealing material contacted to a side surface of said recording element substrate and to said substrate supporting portion; adhesive material fixing said opening partition and said supply passage partition to each other, wherein back sides of opposite ends of said recording element substrate with respect to an arranging direction of said ink supply ports are unfixed by said adhesive material to said substrate supporting portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

The present invention relates to an ink jet recording cartridge manufactured with the use of a manufacturing method which can prevent the substrate of the ink jet head chip from deforming, or separating from the ink jet head chip supporting portion of the housing (outer shell) of the cartridge, by using different adhesives and different bonding methods, depending on which portion of the substrate of the ink jet head chip is attached to the ink jet head chip supporting portion, in order to virtually eliminating (or minimizing) the stress which occurs to the ink jet head chip and ink jet head chip supporting portion, due to the difference in coefficient of linear expansion between the substrate of the ink jet head chip and ink jet head chip supporting portion.

Hereinafter, one of the preferred embodiments of the present invention will be described with reference to the appended drawings.

Figure 1:
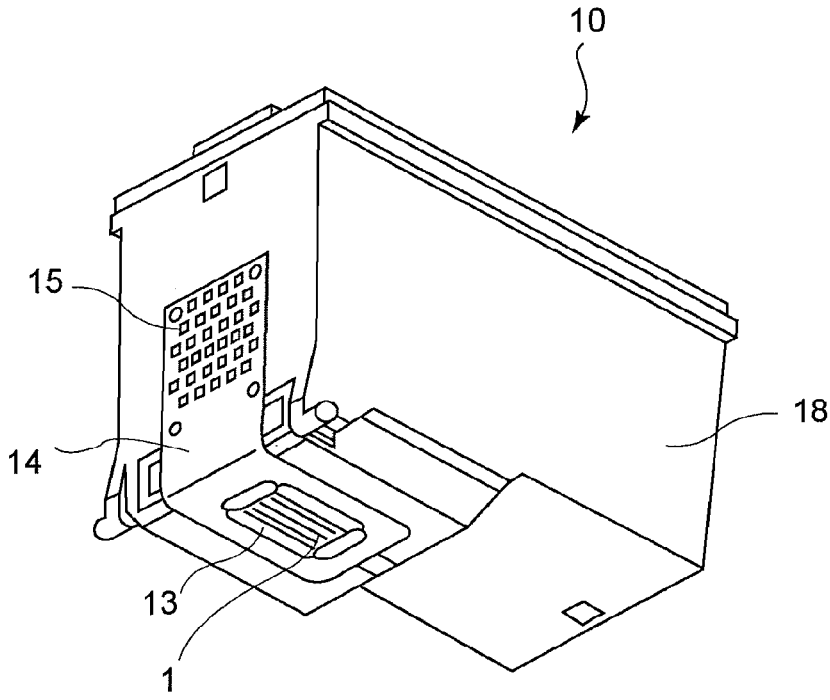
FIG. 1 is a perspective view of a typical ink jet recording cartridge in accordance with the present invention.
Figure 2A:
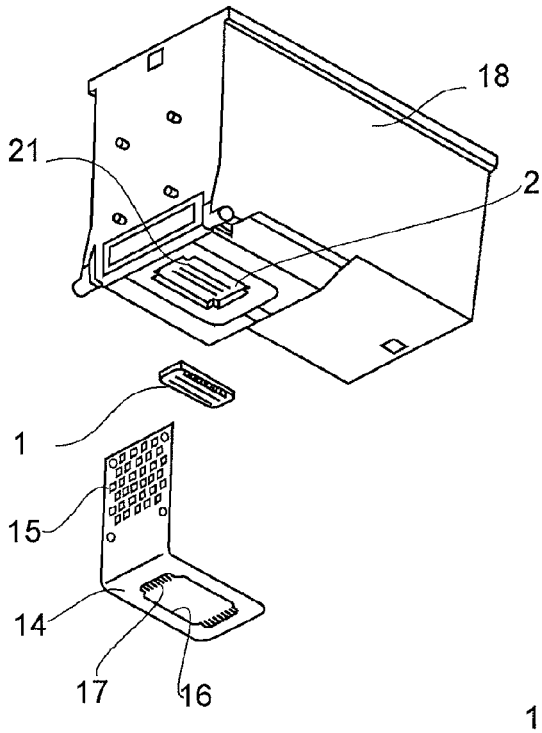
FIG. 2 is an exploded perspective view of the typical ink jet recording cartridge in accordance with the present invention, shown in FIG. 1, showing the structure and components of the ink jet recording cartridge.
Figure 2B:
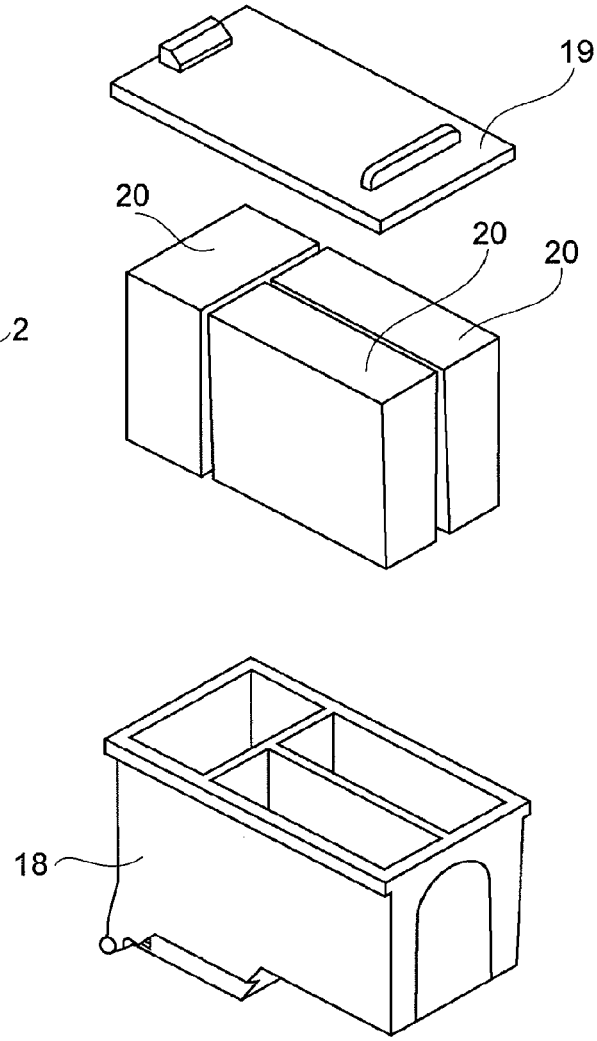

An ink jet recording apparatus cartridge 10, shown in FIGS. 1 and 2, comprises an ink jet recording head chip 1 (which hereafter will be referred to simply as ink jet head chip), which is made up of a substrate 11 and a liquid passage formation plate 8. The ink jet head chip is also provided with multiple electrothermal transducing elements 9, whereas the liquid passage formation plate 8 is provided with multiple ink jetting holes, and multiple internal ink delivery passages dedicated one for one to multiple ink jetting holes. The ink jetting holes are arranged so that their openings 6 line up in three rows (number of rows may be two or four or more) at the top surface (in FIG. 3) of the liquid passage formation plate 8. The liquid passage formation plate 8 is formed on the substrate 11 so that the multiple liquid delivery passages and liquid jetting holes 6 of the liquid passage formation plate 8 align, one for one, with the electrothermal transducing elements 9 on the substrate 11. This ink jet head chip 1 is such a recording head chip that jets ink droplets with the use of thermal energy which the electrothermal transducing elements 9 generate.

Hereafter, this ink jet recording apparatus cartridge 10 and its structural components will be described.

FIG. 1 a perspective view of the ink jet recording apparatus cartridge 10, and FIG. 2 is an exploded perspective view of the ink jet recording cartridge 10. The ink jet recording cartridge 10 is made up of the ink jet head chip 1, a flexible electrical wiring plate 14, an ink container holder 18, and ink containers 20, an ink container holder cover 12, etc.

Figure 3:
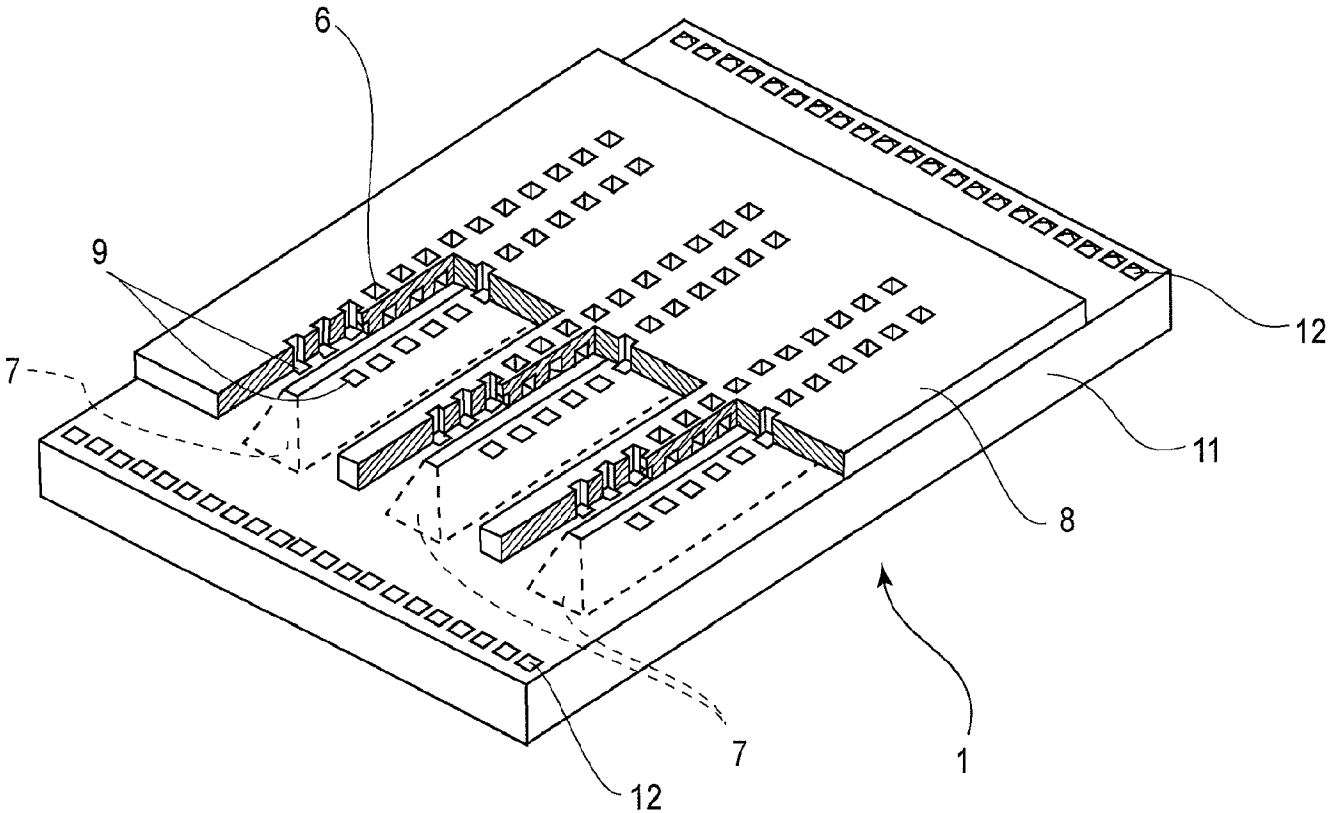
FIG. 3 is a schematic perspective view of a typical ink jet head chip in accordance of the present invention.

FIG. 3 is a partially cutaway schematic perspective view of the ink jet head chip 1, and shows the structure of the ink jet head chip 1. The substrate 11 of the ink jet head chip 1 is a piece of silicon wafer, which is 0.5 mm-1 mm in thickness. It has multiple common ink delivery channels 7, each of which is long and narrow through hole. The common ink delivery channel 7 makes up a part of a liquid delivery passage to a liquid jetting hole 6. It is formed with the use of a method, such as anisotropic etching (which utilizes crystalline orientation of silicon), sand-blasting, etc.

There are multiple rows of electrothermal transducing elements 9 (elements for generating liquid jetting energy) on one of the major surfaces of the substrate 11 of the ink jet head chip 1. There are three pairs of rows of electrothermal transducing elements 9, with one common ink delivery channel 7 located between each pair of rows of electrothermal transducing elements 9. There is also an electrical wiring (unshown) on the substrate 11 of the ink jet head chip 1, which is for supplying the electrothermal transducing elements 9 with electric power. The electrical wiring is formed of aluminum or the like.

The electrothermal transducing elements 9 and electrical wiring can be formed with the use of one of the known film forming technologies.

The ink jet recording cartridge 10 jets the ink delivered through the common ink delivery channels 7, through the liquid jetting holes (6). More specifically, as the electrothermal transducing element 9 in the ink passage of the liquid (ink) passage formation plate 8, which is dedicated one for one to the ink jetting hole (6), generates heat, a bubble is generated in the ink in the dedicated ink passage. As a result, a small portion of the body of ink in the dedicated ink passage is jetted through the liquid (ink) jetting hole (6), which opposes the electrothermal transducing element 9, by the pressure generated by the growth of the bubble.

The flexible electrical wiring plate 14 has a patterned electrical signal passages for applying the electrical signals and electric energy to the electrothermal transducing elements 9 on the substrate 11 of the ink jet head chip 1, in order to jet ink.

The electrical wiring plate 14 has a hole 16, in which the ink jet head chip 1 fits. The electrical wiring plate 14 is provided with lead wires 17, which extend from the edges of the hole 16 and are connected to the electrically connective portion 12 of the ink jet head chip 1. The electrical wiring plate 14 is also provided with an external signal input terminals 15 for receiving electrical signals from the main assembly of the ink jet recording apparatus. The external signal input terminals 15 and the abovementioned lead wires 17 are connected, one for one, to each other with the use of a patterned wiring.

The details of the electrical connection between the electrical wiring plate 14 and the ink jet head chip 1 are as follows: The electrically connective portion 12 of the ink jet head chip 1 is provided with connective bumps, and electrical connection is established between the connective bumps and the lead wires 17 of the electrical wiring plate 14 while maintaining a preset relationship between the bumps and lead wires 17.

The ink container holder 18 is molded of resin, for example. Referring to FIG. 2, the ink container holder 18 functions as a compound ink container by storing multiple ink containers 20, each of which internally stores ink and generates negative pressure. The ink container holder 18 is provided with ink delivery passages through which ink is delivered to the ink jet head chip 1, being therefore capable of delivering ink from each of the ink containers 20 held therein, to the ink jet head chip 1.

Figure 4:
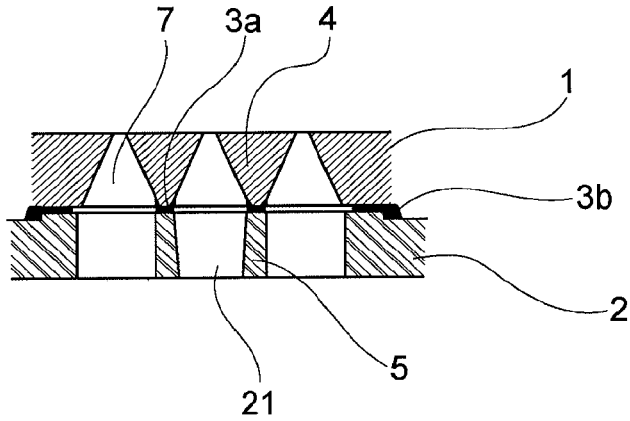
FIG. 4 is a schematic vertical sectional view of the substrate of the ink jet head chip, and ink jet head chip supporting portion, of the ink jet recording cartridge in accordance with the present invention, showing how the substrate of the ink jet head chip is bonded to the ink jet head chip supporting portion.

The route through ink is delivered to the ink jet head chip 1 includes the ink delivery passages 21 of the ink container holder 18 hole for delivering ink to the ink jet head chip 1. The common ink delivery channel 7 of the substrate 11 of the ink jet head chip 1 is in connection to the ink delivery passage 21 of the ink container holder 18. The ink jet head chip 1 is solidly bonded to the ink jet head chip supporting portion 2 of the ink container holder 8 so that the portions 4 of the substrate 11 of the ink jet head chip 1, each of which separates the two adjacent common ink delivery channels 7 of the substrate 11 of the ink jet head chip 1 from each other, are solidly bonded, one for one, with the use of adhesive, to the portions 5 of the ink jet head chip supporting portion 2, each of which separates the adjacent two liquid (ink) delivery passages 21 of the ink jet head chip supporting portion 2 (FIG. 4).

The adhesive 3*a* used for solidly bonding the common ink delivery channel separating portion 4 of the substrate 11, and the ink delivery passage separating portion 5 of the ink jet head chip supporting portion 2, is desired to be low in viscosity, low in the temperature at which it hardens, short in the length of time necessary for curing (hardening), relatively high in the hardness after the curing (hardening), and resistant to ink. As for the choice of adhesive as the adhesive 3*a*, there are various thermally curable adhesives made up primary of epoxy resin, for example.

The electrical joint between the lead wire 17 of the electrical wiring plate 14 and the electrical connective portion 12 of the substrate 11 of the ink jet head chip 1 is covered with one or two layers of sealant, that is, the sealant layer 13 and another layer of sealant which is different in composition from the sealant layer 13, in order to protect the electrical junction from corrosion and/or external mechanical shocks.

More specifically, the sealant layer 13 seals the intersections between the lateral surfaces of the substrate 11 of the ink jet head chip 1 and the ink jet head chip supporting portion 2 of the ink container holder 8. Further, the sealant layer 13 plays the role of keeping the end portions of the substrate 11 of the ink jet head chip 1, in terms of the direction perpendicular to the lengthwise direction of the common ink delivery channel 7, held to the ink jet head chip supporting portion 2.

The cover 19 is welded to the opposite side of the ink container holder 18 (from ink jet head chip supporting portion 2) to prevent ink from leaking from the ink container holder 18.

Next, the preferred embodiment of the present invention will be described in more detail.

The substrate 11 of the ink jet head chip 1 in this embodiment of the present invention is provided with multiple common ink delivery channels 7, which extend in the direction intersectional (perpendicular) to the direction in which the rows of ink jetting holes (6) extend. Each common ink delivery channel 7 is in connection to multiple ink jetting holes 6, through multiple dedicated ink passages in the liquid passage formation plate 8. Further, the ink jet head chip 1 is provided with multiple electrothermal transducing elements 9, which are positioned on the substrate 11 of the ink jet head chip 1 so that they correspond in position to the multiple ink passages in the liquid passage formation plate 8, one for one, and also, so that they oppose the ink jetting holes (6), one for one. The electrothermal transducing elements 9 are energy generating elements for generating the energy for jetting liquid droplets. That is, the electrothermal transducing element 9 generates thermal energy which generates a bubble in the liquid (ink), and a liquid droplet is jetted by the pressure which is generated by the bobble growth. As for the choice of the energy generating element, it may be a piezoelectric element, which causes a liquid droplet to jet by becoming mechanically strained (deformed) as it is subjected to an electric field. The adjacent two common liquid delivery channels 7 are partitioned by one of the portions 4, that is, the common liquid delivery channel separating portion, of the substrate 11 of the ink jet head chip 1.

The ink jet head chip supporting portion 2 (one of walls of ink container holder 8), which supports substrate 11 of the ink jet head chip 1 from the backside of the substrate 11 of the ink jet head chip 1 is provided with multiple ink delivery passages 21. The adjacent two ink delivery passages 21 are separated from each other by one of the ink delivery passage separating portions 5 of the ink jet head chip supporting portion 2. The ink jet head chip 1 is bonded to the ink jet head chip supporting portion 2 so that the common ink delivery channel separating portions 4 of the substrate 11 of the ink jet head chip 1 are bonded, one for one, to the ink delivery passages separating portions 5 of the ink jet head chip supporting portion 2, in order to connect the common ink delivery channels 7 of the substrate 11 of the ink jet head chip 1 to the ink delivery passages of the ink jet head chip supporting portion 2, one for one. The ink delivery passages are formed so that ink in one ink delivery passage does not mix with the ink in the next ink delivery passages. Further, the ink jet head chip 1 is solidly bonded, by the backside of its substrate 11, to the ink jet head chip supporting portion 2 so that at least the opposing two lateral surfaces of the substrate 11 of the ink jet head chip 1, which are parallel to the lengthwise direction of the common ink delivery channel 7, are covered with the sealer layer 13. To described in more detail the method for solidly attaching the substrate 11 of the ink jet head chip 1 to the ink jet head chip supporting portion 2, thermally curable sealant is applied to at least the intersection between each of the opposing two lateral surfaces of the substrate 11 of the ink jet head chip 1, which are parallel to the lengthwise direction of the common ink delivery channel 7, and the ink jet head chip supporting portion 2 of the ink container holder 18, so that the sealant makes contact with at least two surfaces, that is, the lateral surface of the substrate 11 of the ink jet head chip 1, and the surface of the ink jet head chip supporting portion 2, which faces the substrate 11 of the ink jet head chip 1. Then, the sealant is thermally cured.

In terms of the direction in which the common ink delivery channels 7 extend, the end portions of the backside of the substrate 11 of the ink jet head chip 1 are not solidly bonded to the ink jet head chip supporting portion 2 with the use of adhesive 3*a*. As a matter of fact, they are securely held to the ink jet head chip supporting portion 2 by the sealant layer 13. To elaborate the expression the end portions of the backside of the substrate 11 of the ink jet head chip 1 are not solidly bonded with the use of the adhesive 3*a*, there are a case in which the adhesive 3*a* was not applied at all to the end portions of the backside of the substrate 11 of the ink jet head chip 1, and a case in which an adhesive 3*b*, which is less in adhesive strength than the adhesive 3*a*, more specifically, insufficient in adhesive strength to keep the ink jet head chip 1 solidly attached to the ink jet head chip supporting portion 2.

To describe in more detail the adhesive 3*b*, which is less in adhesive strength than the adhesive 3*a*, the adhesive 3*a* and adhesive 3*b* are thermally curable adhesive, the primary ingredient of which is epoxy resin. However, the adhesive 3*b* is smaller in the number of epoxy radicals per molecule than the adhesive 3*a*, or the hardening agent used for the adhesive 3*b* is lower in reaction acceleration rate at a preset curing temperature than the hardening agent used for the adhesive 3*a*. Thus, the adhesive 3*a* is obtained by choosing a proper primary ingredient and/or a proper hardening agent, while taking into consideration the substances used as the materials for the substrate 11 of the ink jet head chip 1 and ink jet head chip supporting portion 2, and the size of the substrate 11 and ink jet head chip supporting portion 2, so that the portions of the ink jet head supporting portion 2 (and/or substrate 11), to which the adhesive 3*b* was applied separate from the ink jet head chip supporting portion 2.

At least the surface of the common ink delivery channel separating portion 4, which faces the ink delivery passage separation portion 5, and the surface of the ink delivery passage separating portion 5, which faces the common ink delivery channel separating portion 4, are coated with the adhesive 3*a*, that is, the adhesive which is sufficient in adhesive strength, so that the common ink delivery channel separating portion 4 and ink delivery passage separating portion 5 remain solidly adhered to each other. The adhesive 3*a* may be applied so that not only is the surface of the common liquid delivery channel separating portion 4, which faces the ink delivery passage separating portion 5, covered with the adhesive 3*a*, but also, the bottom portion (in drawing) of its lateral surface, that is, the bottom portion (in drawing) of the surface of the common liquid delivery channel 7. Applying the adhesive 3*a* so that not only is the surface of the common ink delivery channel separating portion 4, which faces the ink delivery passage separating portion 5, covered with the adhesive 3*a*, but also, the bottom portion of the surface of the common liquid delivery channel 7, increases in overall size the area of adhesion (contact) between the adhesive 3*a* and the common ink delivery channel separating portion 4, increasing in strength the adhesion between the common ink delivery channel separating portion 4 and ink delivery passage separating portion 5. Further, the adhesion between the common ink delivery channel separating portion 4 and ink delivery passage separating portion 5 can be further increased by forming the common ink delivery channel 7 so that its surfaces are not covered with oxides.

As described above, the substrate 11 of the ink jet head chip 1 and ink jet head chip supporting portion 2 (ink jet head chip supporting surface of ink container holder 18) and the are solidly bonded to each other by the surface of each of the common liquid delivery passage separating portions 4, which faces the ink jet head chip supporting portion 2, and the surface of the ink delivery passage separating portion 5, which faces the substrate 11 of the ink jet head chip 1, except across the areas in which the end portions of the substrate 11, in terms of the direction in which the common ink delivery channels 7 of the substrate 11 extend (direction perpendicular to direction in which rows of liquid jetting openings extend), face the ink jet head supporting portion 2. Further, the end portions of the substrate 11, in terms of the direction in which the common ink delivery channels 7 extend, is held to the ink jet head chip supporting portion 2 with the use of the sealant layer 13, instead of the adhesive 3*a*, in order to minimize the thermal stress to which various portions of the substrate 11 of the ink jet head chip 1 and ink jet head chip supporting portion 2 are subjected as the ambient temperature changes (for example, ambient temperature falls) after the thermal curing (hardening) of the sealant layer 13. That is, in practical terms, the abovementioned end portions of the substrate 11 of the ink jet head chip 1 are held to the ink jet head chip supporting portion 2 by the sealant layer 13. The sealant for forming the sealant layer 13 is applied to the intersection between each of the opposing lateral surfaces of the substrate 11 of the ink jet head chip 1 in terms of the direction perpendicular to the lengthwise direction of the common ink delivery channel 7, and the ink jet head chip supporting portion 2, not only to hold the substrate 11 to the ink jet head chip supporting portion 2, but also, to prevent ink from entering the electrically connective portion of the ink jet head chip 1. Incidentally, the sealant may be applied so that the resultant sealant layer 13 covers the edge of the substrate 11 of the ink jet head chip 1, which has the electrically connective portion.

FIG. 4 is a schematic vertical sectional view of the substrate 11 of the ink jet head chip 1, and ink jet head chip supporting portion, of the ink jet recording cartridge 10 in accordance with the present invention. The adhesive 3*a* is a thermally curable adhesive. The adhesive 3*b* is less in adhesive strength than the adhesive 3*a*. It may be a thermally curable adhesive.

The entirety of the back surface (surface which faces ink jet head chip supporting portion 2, that is, surface by which substrate 11 of ink jet head chip 1 is bonded to ink jet head chip supporting portion 2) of the substrate 11 of the ink jet head chip 1 is covered with oxide resulting from thermal oxidization, or naturally occurring oxide. Further, the surfaces of the common ink delivery chamber 7 of the substrate 11 of the ink jet head chip 1 (lateral surfaces of common ink delivery channel separating portion 4) are made up of plain silicon.

Further, as described above, the ink jet head chip supporting portion 2 is provided with the ink delivery passages 21 and ink delivery passage separating portions 5, which are positioned so that as the substrate 11 of the ink jet head chip 1 and ink jet head chip supporting portion 2 are joined, the ink delivery passages 21 align, one for one, with the common ink delivery channels 7 of the substrate 1, and the ink delivery passage separating portions 5 align, one for one, with the common ink delivery channel separating portions 4 of the substrate 11, respectively.

As for the assembly of the ink jet recording cartridge, first, the substrate 11 of the ink jet head chip 1 and ink jet head chip supporting portion 2 of the ink container holder 18 are positioned relative to each other so that the common ink delivery channel separating portions 4 align one for one with the ink delivery passage separating portions 5 (common ink delivery channels 7 align one for one with ink delivery passages 21). Then, the adhesive 3*a*, that is, the adhesive which is strong enough to ensure that the common ink delivery channel separating portions 4 and ink delivery passage separating portions 5 remain adhered to each other, is applied to the abovementioned surface of each common ink delivery channel separating portion 4, except for the end portions, in terms of the direction perpendicular to the lengthwise direction of the common ink delivery channel 7, to which the adhesive 3*b* is applied. It is desired that the adhesive 3*b* is applied so that it does not cover the lateral surfaces of the substrate 11.

Incidentally, the end portions of the backside of the substrate 11 of the ink jet head chip 1, in terms of the direction perpendicular to the direction in which the common ink delivery channels 7 extend, does not need to be coated with the adhesive 3*a* nor adhesive 3*b*.

Figure 5A:
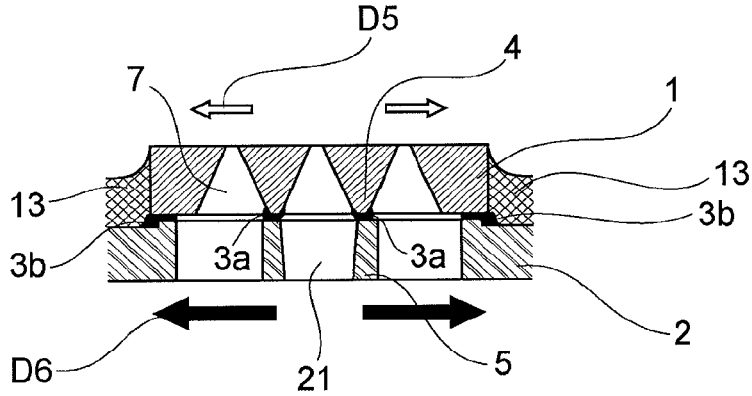
FIGS. 5A-5C are schematic vertical sectional views of the substrate of the ink jet head chip, and ink jet head chip supporting portion, of the ink jet recording cartridge in accordance with the prior art, showing the deformation of the substrate of the ink jet head chip, which occurs during the manufacturing of the ink jet recording cartridge in accordance with the present invention.
Figure 5B:
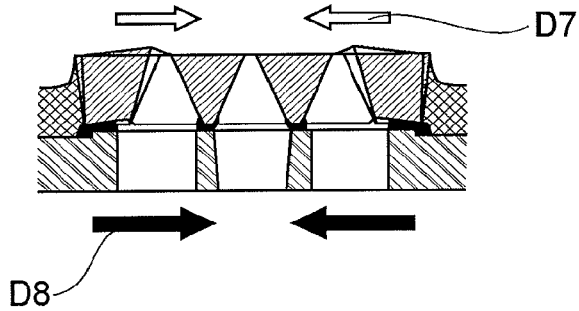

FIGS. 5A-5B are schematic vertical sectional views of the ink jet head shown in FIG. 4, showing the deformation of the substrate 11 of the ink jet head chip 1 and ink jet head chip supporting portion 2, which occurs during the manufacturing of an ink jet recording cartridge. The arrow marks D5-D8 in FIG. 5 show the directions in which the substrate 11 and ink jet head chip supporting portion 2 are thermally expanded while the adhesive 3*a* is hardened, and the directions in which they contract as the ink jet head chip 1 is cooled.

First, referring to FIG. 5A, while the adhesive 3*a* is heated to be hardened, the substrate 11 and ink jet head chip supporting portion 2 expand in the directions D5 and D6 in the drawing due to the presence of the heat applied to harden the adhesive 3*a*. The amount of thermal expansion which occurs to the substrate 11 during this period is extremely small compared to that which occurs to the ink jet head chip supporting portion 2, because the substrate 11, which is formed of silicon, is extremely small in coefficient of linear expansion compared to the ink jet head chip supporting portion 2, which is formed of a resinous substance.

Next, referring to FIG. 5B, after the completion of the process of heating the adhesive 3*a* to harden it, the substrate 11 and ink jet head chip supporting portion 2 are allowed to cool down until their temperature fall to the room temperature. During this period, the substrate 11 and ink jet head chip supporting portion 2 contract in the direction indicated by arrow marks D7 and D8, respectively. In particular, the amount by which the lengthwise end portions of the substrate 11 contract is greater than the amount by which the center portion of the substrate 11 contracts. Further, the end portions of the substrate 11 are bonded to the ink jet head chip supporting portion 2, with the use of the adhesive 3*b* (in some cases, adhesive is not applied at all), and only by its back surface, and are covered (sealed) by the sealant layer 13. Further, the backside of the substrate 11 is covered with oxide attributable to thermal or natural oxidization, being therefore less accommodating to adhesive. Therefore, the bond between the end portions of the substrate 11 and ink jet head chip supporting portion 2, which was made with the adhesive 3*b* applied to the back surface of the end portions of the substrate 11, cannot withstand the compressive force which applies to the adhesive 3*b* as the substrate 11 and ink jet head chip supporting portion 2 cool down to the room temperature. Thus, the end portions of the substrate 11 separate (exfoliated) from the ink jet head chip supporting portion 2. In the case where the adhesive is not applied to the end portions of the substrate 11 at all, the end portions of the substrate 11 are separated (exfoliated) from the ink jet head chip supporting portion 2 even before the cooling of them starts.

Figure 5C:
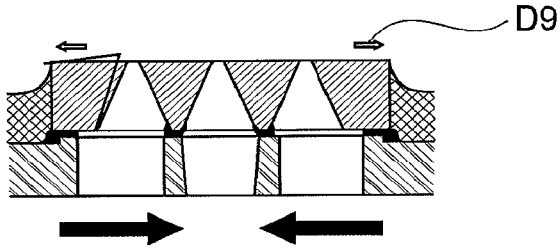

Therefore, the end portions of the substrate 11 are allowed to move relative to the ink jet head supporting portion 2 in the direction indicated by an arrow mark D9 in FIG. 5C, relieving the ink jet head of the stress, preventing thereby the substrate 11 from being deformed. On the other hand, the surface of the common ink delivery channel separating portion 4, which faces the ink jet head chip supporting portion 2, and the portion of the surface of the common ink delivery channel 7, which is contiguous to the surface of the common ink delivery channel separating portion 4, which faces the ink jet head supporting portion 2, are covered with the adhesive 3*a*. Therefore, the bond between the common ink delivery channel separating portion 4 and ink delivery passage separating portion 5 is strong. Therefore, it does not occur that the common ink delivery channel separating portion 4 becomes separated from the ink delivery passage separating portion 5 during the hardening or cooling of the adhesive 3.

Figure 6A:
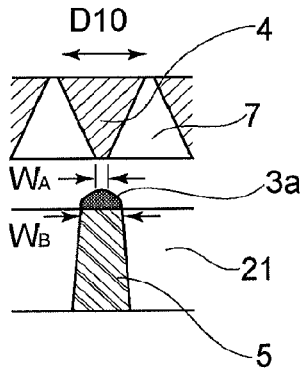
FIGS. 6A and 6B are schematic vertical sectional views of one of the multiple areas of adhesion between the substrate of the ink jet head chip, and ink jet head chip supporting portion, showing how the portion of the substrate of the ink jet head chip, which is between the adjacent two common ink channels of the substrate, is bonded to the corresponding portion of the ink jet head chip supporting portion, which is between the adjacent two ink delivery passages of the ink jet head chip supporting portion.
Figure 6B:
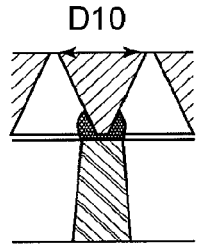

FIGS. 6 are schematic vertical sectional views of one of the multiple areas of adhesion between the substrate 11 of the ink jet head chip 1 and ink jet head chip supporting portion 2 of the ink container holder 18, shown in FIG. 4, and its adjacencies, showing how the common ink delivery channel separating portion 4 of the substrate 11, that is, the portion of the substrate 11, which is between the adjacent two common ink delivery channels 7, is bonded to the corresponding ink delivery passage separating portion 5, that is, the portion of the ink jet head chip supporting portion 2, which is between the adjacent two ink delivery channels 21 of the ink jet head chip supporting portion 2. FIG. 6A shows the common ink delivery channel separating portion 4, and the ink delivery passage separating portion 5, to which the adhesive 3*a* has just been applied, and which is in alignment with the common ink delivery channel separating portion 4. With the substrate 11 and ink jet head chip supporting portion 2 aligned as described above, the substrate 11 is lowered toward the ink jet head chip supporting portion 2 until the common ink delivery channel separating portion 4 of the substrate 11 submerges into the adhesive 3*a* on the ink delivery passage separating portion 5 as deep as shown in FIG. 6B. In terms of the direction indicated by an arrow mark D10, which is perpendicular to the lengthwise direction of the common ink delivery channel 7, the width Wb of the surface of the ink delivery passage separating portion 5, which faces the common ink delivery channel separating portion 4, is greater than the width $W_A$ of the surface of the common ink delivery channel separating portion 4, which faces the ink delivery passage separating portion 5. Therefore, it is ensured that as the substrate 11 is lowered, with the substrate 11 and ink jet head chip supporting portion 2 positioned as described above, the common ink delivery channel separating portion 4 is solidly bonded to the ink delivery passage separating portion 5. Further, by applying the adhesive 3*a* to the ink delivery passage separating portion 5 by the amount slightly greater than the right amount necessary to bond the surface of the ink delivery passage separating portion 5, which faces the common ink delivery channel separating portion 4, and the surface of the common ink delivery channel separating portion 4, which faces the ink delivery passage separating portion 5, it is possible to make the adhesive 3*a* to cover the portion of the surface of the common ink delivery channel 7, which is next to the surface of the common ink delivery channel separating portion 4, which faces the ink delivery passage separating portion 5, without causing the adhesive 3*a* to spread beyond the edges of the ink delivery passage separating portion 5. Incidentally, the surface of the common channel 7 is made up of plain silicon, being therefore superior, in terms of the adhesion to the adhesive 3*a*, to the surface areas of the substrate 11, which are covered with the oxides. Therefore, it does not occur that the common ink delivery channel separating portion 4 becomes separated from the ink delivery passage separating portion 5 when the adhesive 3*a* is hardened or cooled.

Incidentally, referring to FIG. 5A, in the case of the ink jet head in this embodiment, the intersection between each of the lateral surfaces of the substrate 11 of the ink jet head chip 2, which is parallel to the lengthwise direction of the common ink delivery channel 7 and perpendicular to the ink jet head chip supporting portion 2, and the ink jet head chip supporting portion 2, are sealed by being covered with the sealant layer 13 formed of thermally curable sealant. The sealant layer 13 is high in elasticity, being capable of easily and elastically deforming to accommodate the deformation of the substrate 11 and ink jet head supporting portion 2, which is attributable to the stress to which the ink jet head chip 1 is subjected when the adhesive is heated to be hardened, or cooled after the heating.

Further, in this embodiment, the sealant layer 13 seals the gaps which may be present in the area of contact between the abovementioned end portions of the substrate 11, and the ink jet head chip supporting portion 2, during the hardening of the adhesive 3*a*. Therefore, it does not occur that ink leaks through the abovementioned area of contact. Further, after the hardening of the adhesive 3*a*, the sealant layer 13, and the end portions of the substrate 11, partially separate from the ink jet head chip supporting portion 2. However, the sealant layer 13 is elastic. Therefore, the stress which occurs between the end portions of the substrate 11 and the ink jet head chip supporting portion 2 is relieved without creating a gap between the sealant layer 13 and ink jet head chip supporting portion 2. Therefore, it does not occur that ink leaks from, or enter, the ink jet recording cartridge 10, through the interface between the end portions of the substrate 11 and ink jet head chip supporting portion 2.

Figure 7:
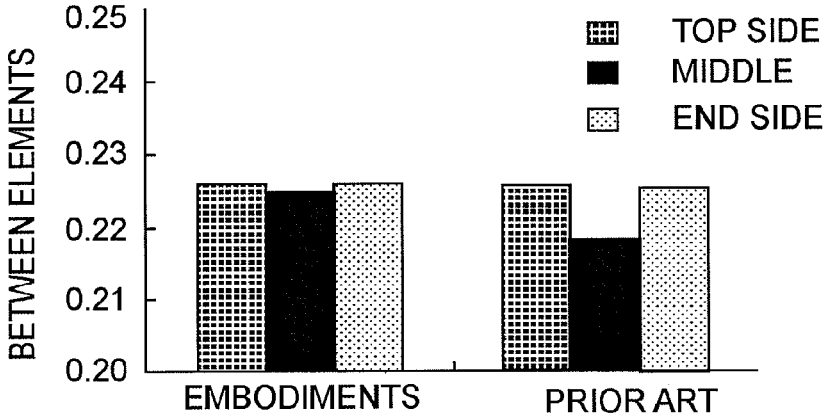
FIG. 7 is a graph showing the amount of deformation which occurred to the substrate of the ink jet head chip in accordance with the present invention, and that which occurred to the substrate of an ink jet head chip in accordance with the prior art.

FIG. 7 is a graph showing the results of the measurement of the distances between the electrothermal transducing elements 9 arranged in a straight line along one side of one of the common ink delivery channels 7 so that they align, one for one, with the ink jetting holes (6) arranged in a straight line along the same side of the same common ink delivery channel 7, and the corresponding electrothermal transducing elements 9 arranged in another straight line along the other side of the same common ink delivery channel 7 so that they align, one for one, with the ink jet holes (6) arranged in a straight line along the same side of the same common ink delivery channel 7. As will be evident from FIG. 7, in the case of an ink jet recording cartridge manufactured with the use of the method, in accordance with the present invention, for bonding the substrate 11 of the ink jet head chip 1 and ink jet head chip supporting portion 2 of the ink container holder 18, the end portion and center portion of the ink jet head chip 1 are roughly the same in the distance between the adjacent two electrothermal transducing elements 9 in terms of the direction perpendicular to the lengthwise direction of the common ink delivery channel 7, whereas in the case of an ink jet recording cartridge manufactured with the use of the method, in accordance with the prior art, for bonding the substrate 11 to the ink jet head chip supporting portion 2, the center portion of the ink jet head chip 1 is smaller in the distance between the adjacent two electrothermal transducing elements 9, in terms of the direction perpendicular to the lengthwise direction of the common ink delivery channel 7, than the end portions of the ink jet head chip 1.

Figure 8:
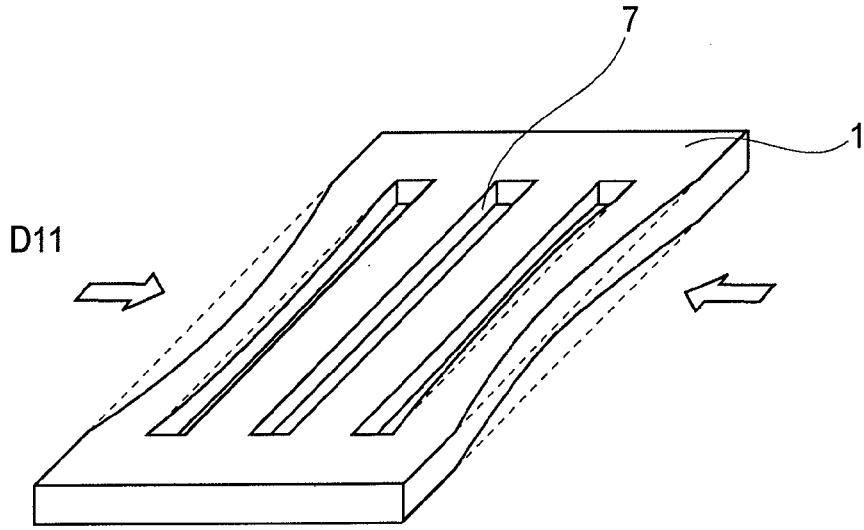
FIG. 8 is a schematic perspective view of the substrate of the ink jet head chip in accordance with the prior art, showing how the common ink channels are deformed.
Figure 9:
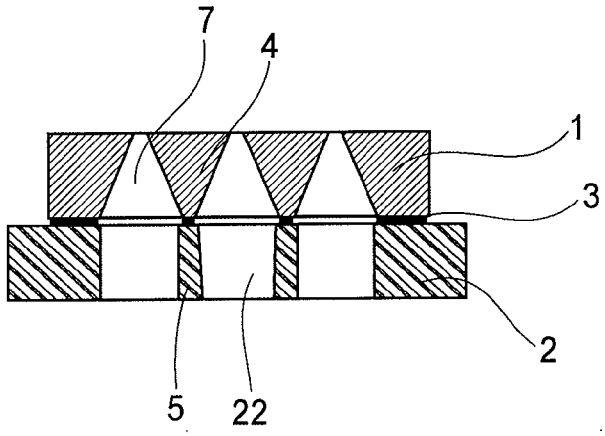
FIG.9 PRIOR ART
FIG. 9 is a schematic sectional view of an ink jet head chip in accordance with the prior art.
Figure 10:
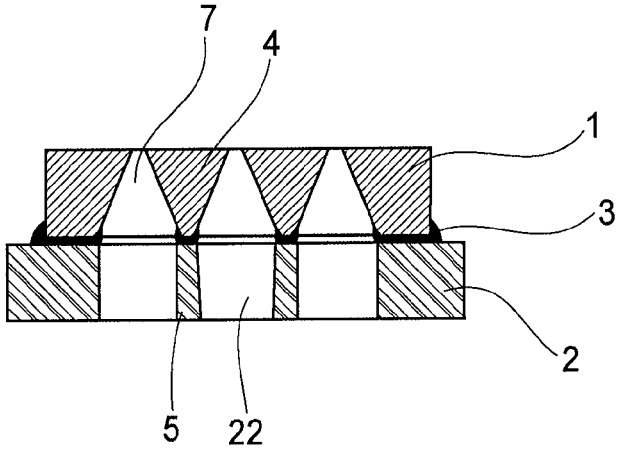
FIG.10 PRIOR ART
FIG. 10 is a schematic sectional view of another ink jet head chip in accordance with the prior art.
Figure 11A:
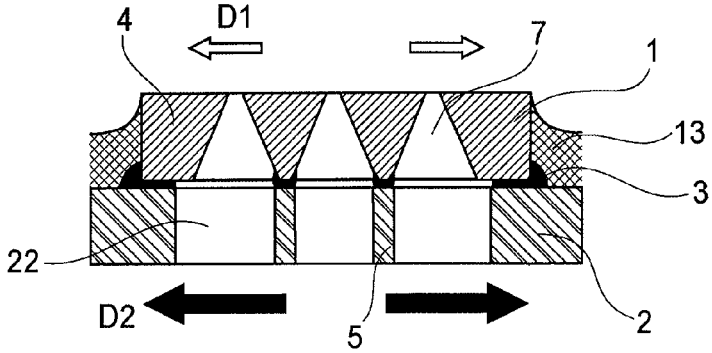
FIG.11A PRIOR ART
FIGS. 11A and 11B are schematic sectional views of an ink jet head chip in accordance with the prior art, showing how the substrate of the ink jet head chip is deformed when the ink jet head chip is bonded to the ink jet head chip supporting portion.
Figure 11B:
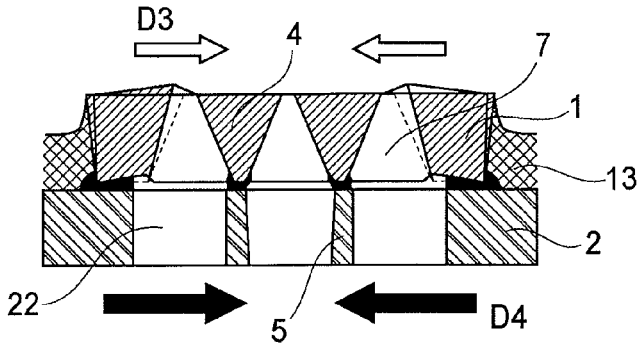
FIG.11B PRIOR ART

This proves that in the case of the ink jet recording cartridge manufactured with the use of the method, in accordance with the prior art, for bonding the substrate 11 to the ink jet head chip supporting portion 2, the center portion of the substrate 11 was deformed toward the center of the substrate 11 as shown in FIG. 8, by the force exerted in the direction indicated by an arrow mark D11, that is, the direction perpendicular to the lengthwise direction of the common ink delivery channel 7 of the substrate 11, during the cooling of the adhesive 3*a*. In comparison, in the case of the ink jet recording cartridge manufactured with the use of the method, in accordance with the present invention, for bonding the substrate 11 and ink jet head chip supporting portion 2, even though compressive force was exerted in the direction indicated by the arrow mark D11 during the cooling of the adhesive 3*a*, the stress caused between the substrate 11 and ink jet head chip supporting portion 2 by the compressive force was relieved by the separation of the end portions of the substrate 11 from the ink jet head chip supporting portion 2, and therefore, virtually no deformation occurred to the substrate 11, or even if it occurred, it was negligibly small.

Next, the method for manufacturing the ink jet printing cartridge in accordance with the present invention will be described.

First, the substrate 11 having the multiple common ink channels 7 and multiple common ink channel separating portions 4 is prepared, along with the ink jet head chip supporting portion 2, which supports the ink jet head chip 1 from the backside of the substrate 11 and has multiple ink delivery passages 21 which correspond to the common ink channels 7, one for one, and multiple ink delivery passage separating portions 5 which correspond to the common ink channel separating portions 4, one for one.

Next, the adhesive 3*a* is applied to one or both of the surfaces of the common ink channel separating portion 4, which faces the ink delivery passage separating portion 5, and the surface of the ink delivery passage separating portion 5, which faces the common ink channel separating portion 4.

Then, the adhesive 3*b*, which is weaker in adhesive strength than the adhesive 3*a*, is applied to the back surface of each of both of the end portions of the substrate 11 of the ink jet head chip 1 in terms of the direction perpendicular to the lengthwise direction of the common ink delivery channel 7, and/or the corresponding portions of the ink jet head chip supporting portion 2.

Then, the substrate 11 of the ink jet head chip 1 and ink jet head chip supporting portion 2 of the ink container holder 18 are positioned relative to each other so that the common ink delivery channels 7 and common ink delivery channel separating portions 4 of the substrate 11, and the corresponding ink delivery passages 21 and ink delivery passage separating portions 5 of the ink jet head chip supporting portion 2, align one for one.

Incidentally, the order in which the step for applying the adhesive 3*a*, step for applying adhesive 3*b*, step for positioning the substrate 11 and ink jet head chip supporting portion 2 relative to each other, are to be carried out, is optional.

Next, the substrate 11 and ink jet head chip supporting portion 2 are joined with each other, with the presence of the adhesives 3*a* and 3*b* between the two, while being kept correctly positioned relative to each other as described above.

Then, the adhesive 3*a* is thermally hardened to solidly bond the common ink delivery channel separating portions 4 and ink delivery passage separating portions 5 one for one.

Further, while the thermally processed adhesive 3*a* cools down, sealant is applied to the intersection between each of the opposing lateral surfaces of the substrate 11, which is perpendicular to the lengthwise direction of the common ink delivery channel 7, and the ink jet head chip supporting portion 2, to form the sealant layer 13 to secure the substrate 11 and ink jet head chip supporting portion 2 relative to each other. During this period, however, the end portions of the substrate 11, in terms of the direction perpendicular to the lengthwise direction of the common ink delivery channel 7, which have been bonded to the ink jet head chip supporting portion 2 with the use of the adhesive 3*b*, become separated from the ink jet head chip supporting portion 2. Therefore, the substrate 11 is relieved of the stress which occurs to the substrate 11 as the adhesive 3*a* is cooled.

Incidentally, among the abovementioned steps, the step for applying the adhesive 3*b* may be omitted to manufacture an ink jet printing cartridge which does have the adhesive 3*b*.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 339975/2006 and 297957/2007 filed Dec. 18, 2006 and Nov. 16, 2007 which are hereby incorporated by reference.

What is claimed is:

1. An ink jet head comprising:

a recording element substrate including a plurality of ink supply ports and a supply port partition between adjacent ink supply ports;

a substrate supporting portion which supports the recording element substrate at a back side thereof, wherein the substrate supporting portion includes ink supply passages corresponding to the ink supply ports and a supply passage partition corresponding to the supply port partition;

a sealing material contacted to a side surface of the recording element substrate and to the substrate supporting portion;

first adhesive material fixes the supply port partition and the supply passage partition to each other, wherein back sides of opposite ends of the recording element substrate with respect to an arranging direction of the ink supply ports are unfixed by the first adhesive material to the substrate supporting portion; and wherein a second adhesive material having an adhesivity lower than the first adhesive material is applied between the back sides of the opposite ends of the recording element substrate and said substrate supporting portion, which are unfixed from each other by the first adhesive material.

2. An ink jet head according to claim 1, wherein the first and the second adhesive materials are thermosetting adhesive materials comprising epoxy resin material as a main material, and the second adhesive material has a number of epoxy groups per molecular weight which is smaller than that of the first adhesive material.

3. An ink jet head according to claim 1, wherein the first and the second adhesive materials are thermosetting adhesive materials comprising epoxy resin material as a main material, and a curing material for the second adhesive material has a reaction rate which is smaller than that of the first adhesive material at a curing temperature for the first adhesive material.

4. An ink jet head according to claim 1, wherein an inner surface of each of the ink supply ports comprises silicon, and the first adhesive material extends from between the supply port partition and the supply passage partition to the inner surface of the ink supply port.

* * * * *